United States Patent [19]

Moss et al.

[11] Patent Number: 4,950,868

[45] Date of Patent: Aug. 21, 1990

[54] HEATED GLOVES

[75] Inventors: Gary J. Moss, Morton Grove; Michael Toler, Chicago; Steven Rehkemper, Chicago, all of Ill.

[73] Assignee: Marmon Holdings, Inc., Chicago, Ill.

[21] Appl. No.: 319,172

[22] Filed: Mar. 3, 1989

[51] Int. Cl.[5] ..... H05B 3/00

[52] U.S. Cl. ..... 219/211; 219/492; 219/494; 219/529; 219/543

[58] Field of Search ..... 219/211, 212, 217, 492, 219/494, 528, 529, 535, 543, 545; 36/2.6

[56] References Cited

U.S. PATENT DOCUMENTS

| | | | |
|---|---|---|---|
| 4,021,640 | 5/1977 | Gross | 219/211 |
| 4,273,989 | 6/1981 | Hinton | 219/211 |
| 4,665,308 | 5/1987 | Coorvoisier | 219/211 |
| 4,780,968 | 11/1988 | Bragagnolo | 219/211 |

*Primary Examiner*—Roy N. Envall, Jr.

*Attorney, Agent, or Firm*—Jon C. Gealow; James M. Wetzel

[57] ABSTRACT

The invention provides heated gloves. A battery saver circuit applies heat with a temperature responsive pulse width modulation that changes the duty cycle at which heat is applied to the glove. The battery saver circuit is part of a battery pack which is mounted on the back of the glove. A reflective foil is contained within the glove for directing heat toward the wearer's hand.

20 Claims, 4 Drawing Sheets

HEATED GLOVES

This invention relates to heated garments and more particularly—although not exclusively—to heated gloves.

The inventive device will find a use in any of many different kinds of garments, such as: gloves, socks, hats, ear muffs, underwear, and the like. The term "gloves" is used herein for convenience of expression, to describe all of these and similar garments. Therefore, the term "gloves" is to be construed as broadly as the prior art permits in order to encompass all suitable garments.

One problem with such a garment is the limited amount of energy in the power supply that is used to heat it. Since each ounce that is attached to the hand must be lifted, moved, lowered, etc. everytime that the hand is moved, even a slight amount of added weight can become very tiring. Therefore, it is desirable for the smallest and lightest practical batteries to be used. As a result, there has been a choice between gloves with large batteries that were too heavy or gloves which could not be heated over a sufficient period of time without having to repeatedly change batteries. One example of a heated glove is found in U.S. Pat. No. 4,021,640.

Accordingly, an object of this invention is to provide new and improved means for and methods of extending the period of time during which gloves, or the like, may be heated by a single set of relatively small batteries. Here, an object is to provide electronic control systems that may control a heating element in a manner which greatly increases the effective heating time from a single set of batteries.

Yet another object of the invention is to provide better insulated gloves which enable a heating system and its electronic controls to make more efficient use of the energy in a battery.

Still another object of the invention is to provide a general purpose electronic control system which may be used to control the heating of substantially any garment, especially one using batteries as a source of energy.

In keeping with an aspect of the invention, these and other objects are provided by a well insulated glove with an electronic driving circuit adapted to provide a maximum average amount of heat for a minimum expenditure of energy. In greater detail, the control circuit may be switched. to provide a continuous current which brings the temperature up to a comfortable level. Once that temperature level is reached, the control circuit may switch the current on and off with a duty cycle which changes with variations in the ambient temperature in order to maintain the comfortable level, resulting in an intermittent drain of current. The control circuit is built into a battery pack comprising a plastic case containing batteries which may be inserted into a small pocket, on the back of the glove. The insulated gloves include reflective foil to retain the heat and direct it toward the wearer's hand.

A preferred embodiment of the invention is shown in the attached drawing wherein.

Figure 1:
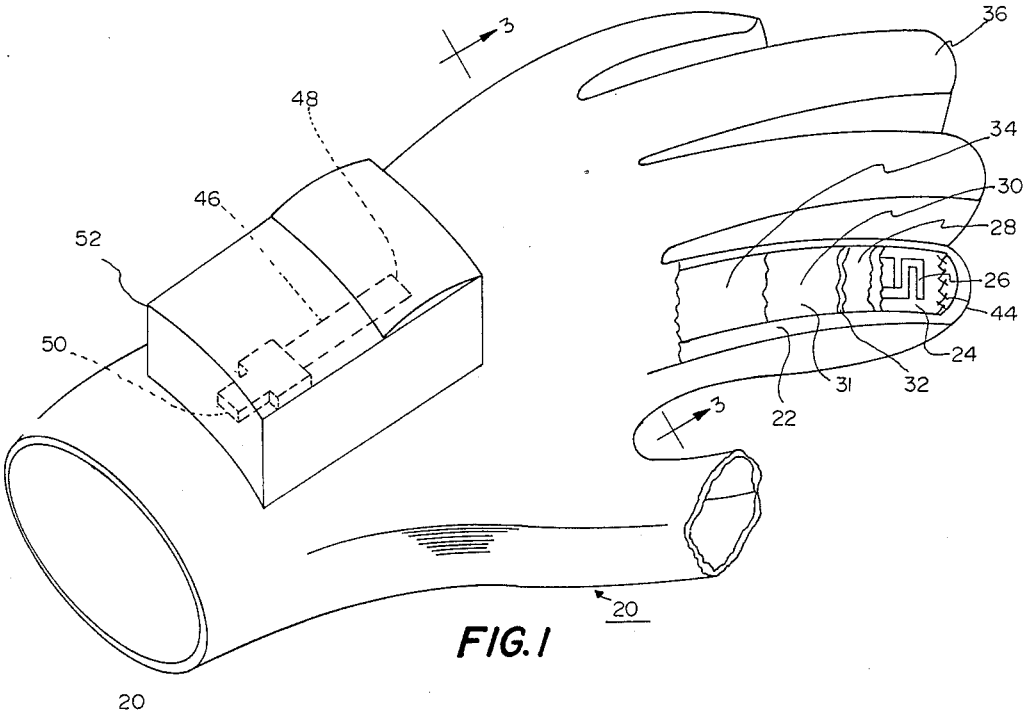
FIG. 1 is a perspective view of a glove incorporating the invention.
Figure 3:
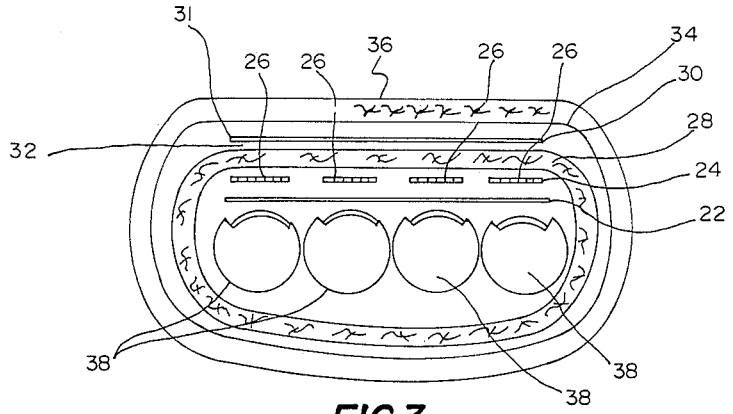
FIG. 3 is a cross section of the glove taken along line 3—3 of FIG. 1.

The inventive glove 20 (FIG. 1) may have an outer shell of any suitable material although a heavy leather glove of substantially conventional external design and construction is preferred for high quality ski or work gloves. The glove is lined with a suitable fabric 22, such as a tricot, again of any suitable construction and design. Over the tricot is a plastic insert 24 which has, a printed circuit element with a resistance circuit 26 formed thereon. Above the plastic insert 24 is an insulating fabric material 28, such as that sold under the trademark "The insulate". Above the insulating material 28 i a layer 30 which is a reflective foil 31 such as aluminized plastic film bonded to a somewhat paper-like material 32, the reflective foil 30 being on the side of material 32 which is away from the hand. Finally, the foil is covered by a rubber-like bladder 34 of waterproof material which can breathe, such as a material sold under the trademark "Gore-Tex". These layers and the outer leather shell 36 integrally form the glove 20. In FIG. 3, the four holes 38 are the finger openings as seen from inside the palm area of the glove.

Figure 4:
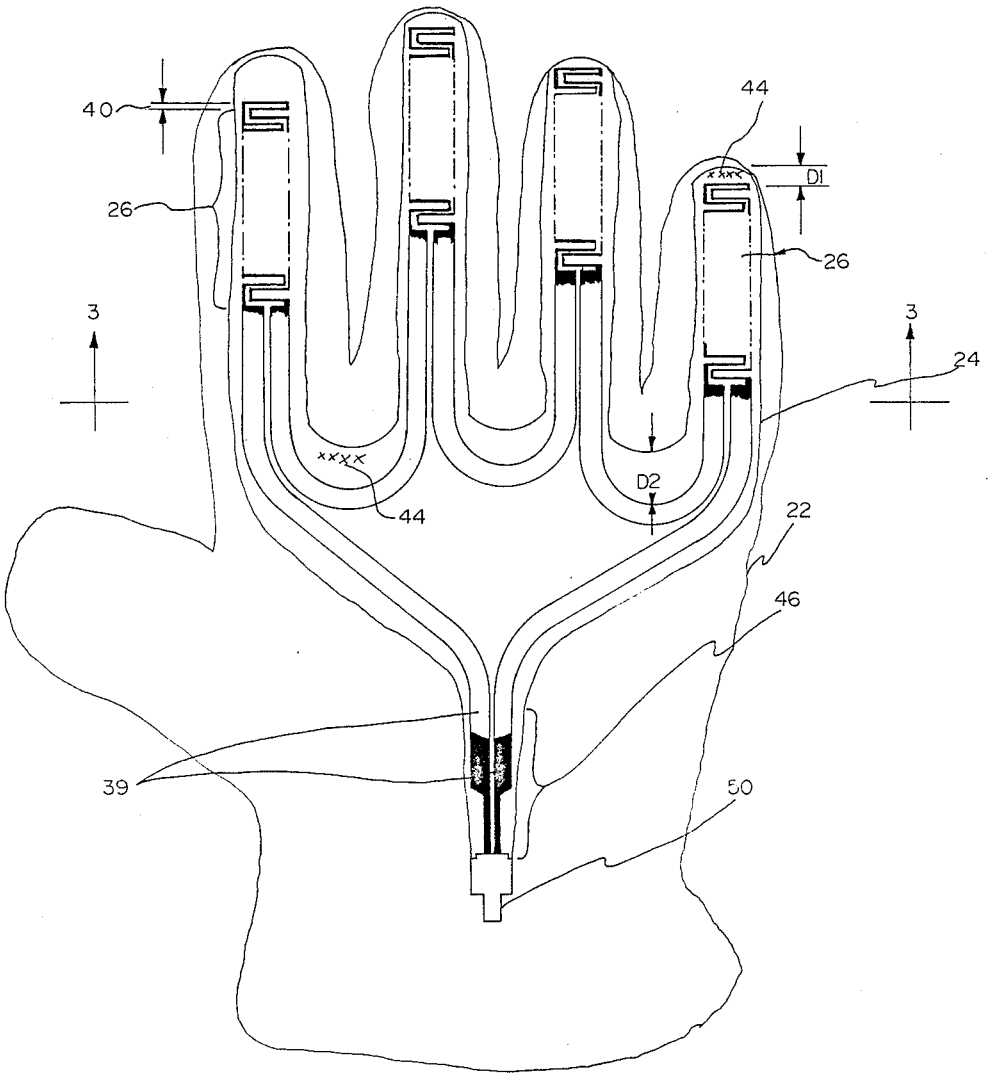
FIG. 4 is a plan view of a heating element.

The construction of the heating element is best seen in FIG. 4 as covering the back of the hand, and finger areas of the glove. The plastic insert 24 is formed of plastic film sheets with a printed circuit on one of them. Preferably, the printed circuit is a nickel alloy which has a generally wide conductor strip line area, as at 39, to conduct electricity with a low resistance and with a minimum of dissipation of energy as heat. In the areas over the fingers, the width of the strip line is greatly reduced (as at 40) in order to create a high resistance which heats when electricity energizes it. The other plastic film sheet is bonded over the printed circuit in order to protect it. Stated another way, the printed circuit is sandwiched between two sheets of plastic film which are bonded together to form plastic insert 24 plastic film. The sandwiched and heating element is die cut to fit into an area over the fingers and the back of the hand or the glove.

Figure 2:
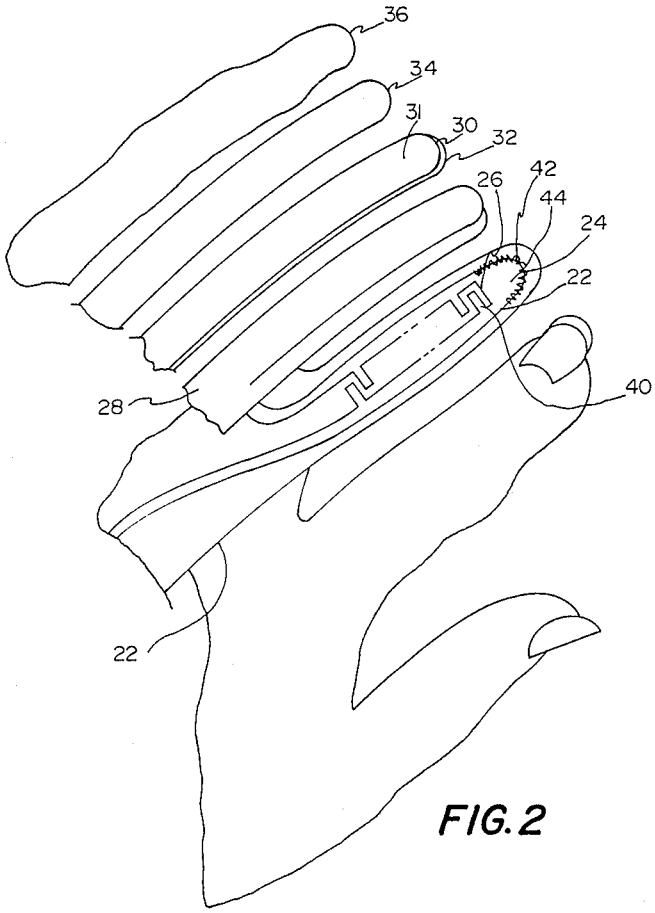
FIG. 2 is an exploded view of the elements of the glove superimposed over the index finger of a human hand inside the glove.
Figure 5:
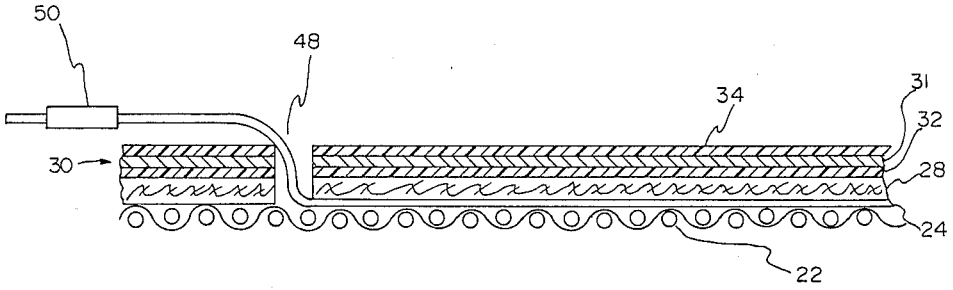
FIG. 5 is a cross-section of the glove, with a lead to the heating element emerging through a slit in the insulation.

The plastic insert 24 extends a considerable distance D1 beyond the ends of the printed circuit resistive element so that the tips of the fingers of the plastic insert may be sewn into the glove, as shown at 44 (FIG. 2) without piercing the printed circuit. Likewise, as the root of the fingers, there should be a distance D2 of clear plastic film between the strip line 39 and the edge of the plastic film in order to receive stitching without injury to the printed circuit. The plastic insert 24 32 ends in a neck or lead 46 (FIG. 4) which passes through a slit 48 (FIG. 5) formed in the layers of material which line the gloves.

The lead 46 terminates in a plug 50 that may be coupled to a battery pack.

At any suitable location, such as on of the hand, a pocket 52 (FIG. 1) is formed on the glove to receive a battery pack. In this particular example, the pocket 52 is closed by a flap which is secured in place by a hook and loop fastener, such as that sold under the trademark "Velcro". Other suitable fasteners may be used, such as snaps, zippers, or the like. The end of lead 46 is inside the pocket 52, where it may be plugged into the battery pack.

The battery pack is packaged in a three part plastic box 60 shown in FIG. 6A–6C and FIG. 7. In greater detail, the lower section 62 (FIG. 6A) of the battery pack plastic box includes a printed circuit board 64, a rack 66 and, pinions. 68, and an opening 70 for receiving the plug 50 on the plastic insert 24 heating element assembly, (FIG. 4). Guide rail 71 mates with a groove (not shown) in the bottom of the rack 66 to enable it to slide back and forth (directions A and B) while turning the pinion 68. As the rack 66 slides back and forth the pinion 68 rotates to adjust an electronic control circuit mounted on printed circuit board 64. The rack includes, an embossment 72 which projects upwardly far enough to provide a convenient control which may be slid back and forth by one who is wearing heavy gloves. The rack 66 and pinion 68 may, for example, be low cost plastic piece parts.

The middle section 74 of the battery pack plastic box has an opening slot 76 through which the rack embossment 72 projects far enough for easy control movement. The sizes are such that the rack is captured under the edges of slot 76 for enabling a sliding movement. Three compartments 78 receive three batteries 80, 80, 80 (FIG. 7), preferably of the AA size.

The upper section 82 (FIG. 6C) is a cover which closes over and retains the batteries.

While not explained in detail, suitable embossments, tabs, slots and the like are provided on the parts 62, 74, and 82 so that they snap together. Preferably, the cover 82 is easy to unsnap in order to facilitate replacement of the batteries. It is much more difficult to unsnap the middle section 74 from the lower section 62 so that the printed circuit board 64, electronic components, rack 66, and pinion 68 are not damaged if the user carelessly tries to open the battery pack box.

Figure 8:
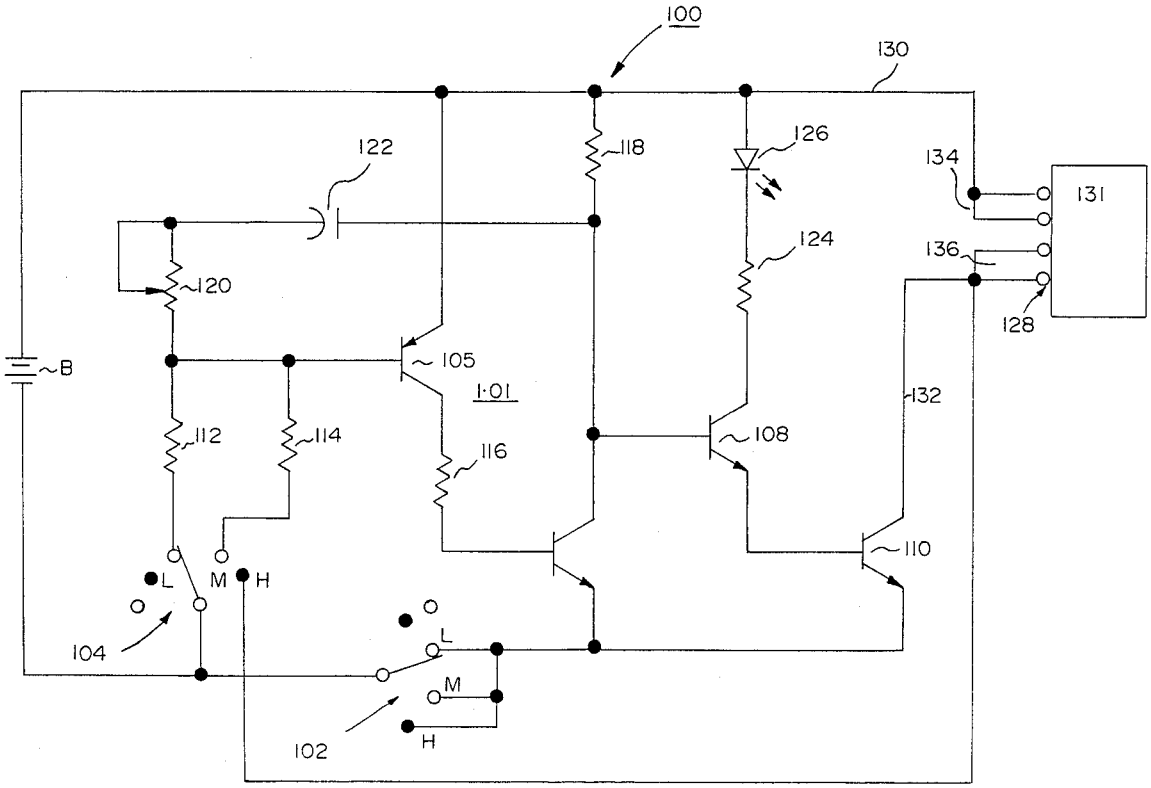
FIG. 8 is a schematic circuit diagram of the control circuit for controlling an application of heat to the gloves.
Figure 6A:
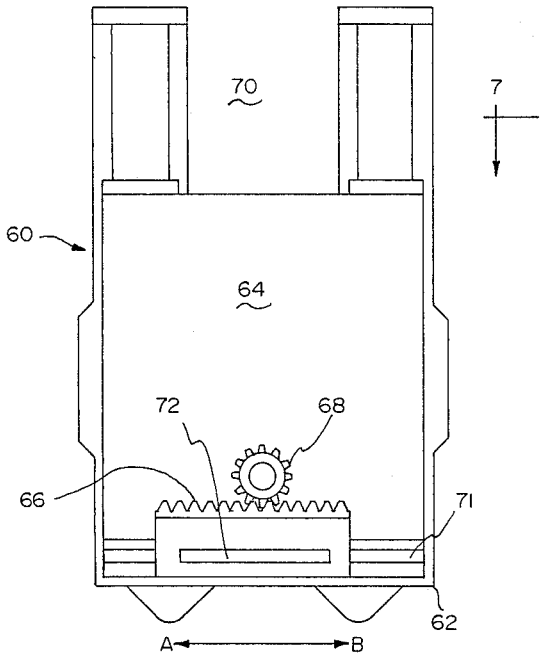
FIG. 6A is a top plan view of a lower section of a plastic box that holds the battery pack.
Figure 6B:
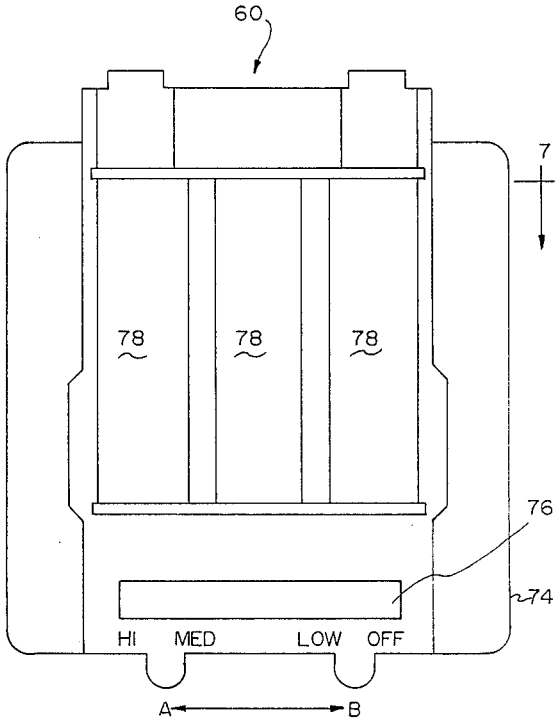
FIG. 6B is a top plan view of a middle section of the battery pack box.
Figure 6C:
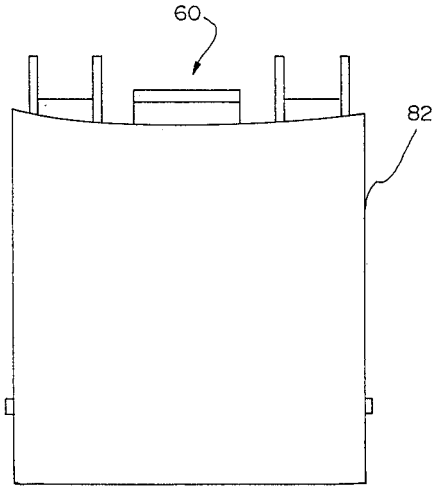
FIG. 6C is top plan view of a cover for the top section of the battery pack box.
Figure 7:
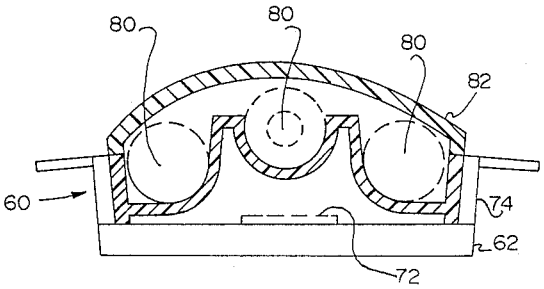
FIG. 7 is an end view of the three parts (FIG. 6A–6C) of the battery pack box in an assembled condition.

When switched on, the circuit 100 (FIG. 8) provides either a direct connection between the battery and the heating element or a connection through a pulse width modulator 101 which responds to a sensed temperature, depending upon the position of the sliding embossment 72 (FIG. 4A) in the slot 76 (FIG. 6B). A , direct, intermittent, or oscillating circuit may also be used as a control circuit in place of the modulator 101.

In greater detail, printed circuit board 64 has terminal areas printed thereon which are electrically contacted by wipers moved under the control of pinion 68, in order to provide the necessary switching and control functions. These functions are represented by switches 102 and 104 in FIG. 8 which have four positions: off "0", low "L", medium "M", and high "H".

The modulator includes four transistors, two of which 104 and 106 are coupled to form a relaxation oscillator. Transistor 108 is part of an amplifier circuit. Transistor 110 is a driver for supplying current to the heater element (FIG. 4). The resistors 112, 114 supply two different base bias potentials to the transistor 105 in order to provide low and medium levels of heat, respectively. Resistor 116 provides current limiting. Resistor 118 is very small relative to resistors 112, 114 in order to provide a pull up function. Potentiometer 120 is set in the factory to give a proper operating range of relaxation oscillations. The capacitor 122 provides a timing function which determines the duty cycle of the relaxation oscillator. Resistor 124 is a collector load for transistor 108. The LED (light emitting diode) 126 lights to indicate when heat is being supplied to the gloves.

The transistor 108 is coupled to switch on and off responsive to the on/off cycle of transistor 106. The transistor 110 is coupled to switch "on" whenever the transistor 108 is "on". The heating circuit may be traced from battery B through wire 130, connector 131 the heating element (FIG. 4) and return to connector 131 wire 132, transistor 110 and terminal L or M of the switch 102, to the battery B.

Means are provided for sensing ambient temperature. In greater detail, all transistors are somewhat temperature sensitive. Most circuits seek to minimize this sensitivity by using techniques such as providing relatively large emitter resistors so that the voltage drops across them will swamp out a comparatively small temperature caused variation in the drops across the transistors. This control circuit does not have the emitter resistors, thereby accentuating the temperature sensitivity of the transistors. It was found that this sensitivity could be made more precise by using a very accurate capacitor 122 with a very narrow range of manufacturing tolerances. Therefore, a tantalum capacitance was used to set the timing in the relaxation oscillator.

Means are provided for modulating the width of drive pulses as a function of temperature in order to supply an amount of heat which is appropriate to the user's needs. In greater detail, the capacitor 122 charges through resistor 118 to a voltage which causes the transistor 104 to switch on, which in turn switches on the transistor 106 and it discharges the capacitor 122. When it discharges, the transistors switch off and the capacitor charges again during the next cycle. As a result of the temperature sensitivity of the transistors, an output signal appears at the collector of the transistor 106, which changes the circuit's duty cycle so that the width of the output wave becomes greater as the sensed temperature falls and narrower as the temperature rises.

The transistor 108 supplies base current for switching the driver transistor 110 on and off. As the output wave form of the relaxation oscillator becomes wider, the amplifier 108 is switched on for a greater percentage of the time. Conversely, as the output wave form becomes narrower, the amplifier 108 is switched off for a greater percentage of the time. Thus, as the temperature becomes colder, transistor 110 is on for a greater percentage of the time to supply more heat.

The connector 131 has four mechanical contacts, 128 which are electrically interconnected at 134 and 136 to effectively make two electrical terminal's. This arrangement is used because connector 131 should have a small size in order to reduce weight to a minimum, but there is also a need for a mechanically strong connector that is able to withstand hand movement. This is especially true in sports events such as skiing where a relatively great strain is repeatedly placed on the glove. For this reason, four mechanical connectors are used to provide the necessary mechanical strength even though only two electrical connections are required.

When the switch is set on "high" the transistor circuits should be inactivated since the battery B is connected directly across the heating element. Transistor 104 is open circuited when switch 100 is setting on terminal H. When switch 100 is on terminal H, the system "ground" is applied from battery B directly to interconnection 136 and 132 and thus to the collector of the transistor 110. With ground on its collector, the transistor 110 can not turn on.

The advantages of the invention are provided by a better insulated glove and an electronic battery saving circuit. It is difficult to say exactly how much longer the battery may last with the invention as compared to without the invention since an answer to that question depends upon both the temperature and the personal preference of the user. However, about a six to one advantage is a reasonable estimate. Without the invention, batteries may last for about one hour. With the invention and under similar conditions, the batteries may last for up to about six hours.

Those who are skilled in the art will readily perceive how to modify the invention. Therefore, the appended claims are to be construed to cover all equivalent structures which fall within the true scope and spirit of the invention.

We claim:

1. A garment comprising a heating element, an insulating member, a reflective foil and an outer shell, means for energizing said heating element either directly or intermittently with a duty cycle depending upon a user setting, and temperature sensitive means for changing said duty cycle to supply energy to said heater over greater percentages of the time as the sensed temperature becomes lower or over lesser percentages of the time as the sensed temperature becomes higher, said reflective foil being positioned to reflect heat from said heating element toward the person wearing the garment.

2. The garment of claim 1 wherein said heating element comprises a printed circuit strip line sandwiched between sheets of plastic film.

3. The garment of claim 2 wherein said garment is a glove and said strip line is shaped and proportioned to extend over the backs of the wearers fingers.

4. The garment of claim 3 wherein said plastic film some distance beyond and around the strip line so that said plastic film may be sewn into said glove without damage to the strip line.

5. The garment of claim 3 wherein said strip line is a nickel alloy.

6. The garment of claim 3 wherein said plastic film terminates in a connector in the region of the back of the hand, a pocket formed on the back of the hand part of the glove, a battery pack removably fitted into said pocket, and a connector in said battery pack to receive the connector on said plastic film.

7. The garment of claim 6 and an electronic circuit in said battery pack, said circuit comprising a temperature sensitive relaxation oscillator having an on/off cycle which sets said duty cycle.

8. The garment of claim 7 wherein said temperature sensitive relaxation oscillator comprises a transistorized circuit having no emitter resistor elements.

9. The garment of claim 8 and means for grounding a collector of at least one transistor in said circuit for holding it in an "off" condition during periods when said energy is applied directly to said heating element.

10. A device for heating a garment comprising a heating element, oscillator means including temperature sensitive means for changing the duty cycle of said oscillator as a function of variations of the ambient temperature, said duty cycle having drive pulses which become wider as said ambient temperature goes down, and a driver transistor controlled by said oscillator for controlling an intermittent application of energy to said heating element during time periods corresponding to said width of said drive pulses.

11. The device of claim 10 further comprising means for simultaneously grounding an electrode on at least one transistor for precluding said intermittent application of aid energy to said heating element, and for non-intermittently applying energy directly to said heating element.

12. The device of claim 11 wherein said garment is a glove and said heating element is a resistive strip line printed on and sandwiched between two sheets of plastic film; said plastic film and strip lines extending down at least one finger of said glove, said oscillator and transistor being parts of a circuit mounted on a printed circuit board secured to said glove, and batteries coupled through said circuit to said heating element.

13. The device of claim 12 further comprising reflective oil positioned between said heating element and an external surface of said glove for reflecting the heat of said heating element toward a hand inside said glove.

14. The device of claim 13 further comprising a pocket on said glove for receiving a battery pack containing said printed circuit board, connector means associated with said heating element and with said battery pack for enabling replacement of batteries in said pack.

15. The device of claim 14 further comprising rack and pinon means associated with said battery pack for controlling an application of energy to said heating element whereby it is easy to slide said rack in order to make an adjustment while the user is wearing heavy gloves.

16. The device of claim 14 further comprising connector means having more mechanical contacts than are required to make electrical connections, and means for electrically combining said contacts to provide said required electrical connections while also providing added mechanical strength.

17. A glove with a heating element energized by a pulse width modulated system, temperature sensitive means for adjusting said pulse width as a function of ambient temperature, and means for applying energy directly to said heating element while inhibiting said pulse width modulating means.

18. A glove comprising a heating element, said heating element being a printed circuit strip line sandwiched between sheet of plastic film, said strip line being shaped and proportioned to extend over the backs of the wearer's fingers, said strip line terminating in a connector in the region of the back of the hand, a pocket formed on the back of the hand part of the glove, a battery pack removably fitted into said pocket, and a connector in said battery pack to receive the connector on said strip line, an insulating member, a reflective foil and an outer shell, means for energizing said heating element either directly or intermittently through an electronic circuit in said battery pack, said circuit comprising a temperature sensitive relaxation oscillator having an on/off cycle which sets said duty cycle, said duty cycle depending upon a suer setting, said temperature sensitive relaxation oscillator changing said duty cycle to supply energy to said heater over greater percentage of the time as the sensed temperature becomes lower or over lesser percentages of the time as the sensed temperature becomes higher, said reflecting foil being positioned to reflect heat from said heating element toward the person wearing the garment.

19. The garment of claim 18 wherein said temperature sensitive relaxation oscillator comprises a transistorized circuit having no emitter resistor elements.

20. The garment of claim 19 and means for grounding a collector of at least one transistor in said circuit for holding it in an "off" condition during periods when said energy is applied directly to said heating element.

* * * * *

UNITED STATES PATENT AND TRADEMARK OFFICE
CERTIFICATE OF CORRECTION

PATENT NO. : 4,950,868

DATED : August 21, 1990

INVENTOR(S) : Gary Moss, et al.

It is certified that error appears in the above-identified patent and that said Letters Patent is hereby corrected as shown below:

column 2, line 28, cancel "The insulate" and substitute -Thinsulate-
column 2, line 28, following the numeral 28, cancel "i" and substitute -is-
column 2, line 42, after "them" and before the "." insert -, and positioned between them-
column 2, line 43, before "plastic" insert -two-
column 2, line 54, before the "." cancel "plastic film"
column 2, line 54, after "sandwiched" insert -plastic film-column 3, line 3, after "on" insert -the back-column 3, line 16, after "and" cancel the ","

column 3, line 16, after "pinions" cancel the "."

column 3, line 28, before "plastic" insert -moldedcolumn 3, line 52, cancel "(FIG. 4A)" and substitute -(FIG. 6A)- column 3, line 52, after "A" cancel the ","

column 3, line 62, after "modulator" insert the numeral -101-column 3, line 63, cancel the number "104" and substitute the number -105-column 5, line 5, before the numeral "132" insert -wire-

Claim 11, column 6, line 11, cancel "aid" and substitute -said-

Claim 13, column 6, line 23 cancel "oil" and substitute -foil-

UNITED STATES PATENT AND TRADEMARK OFFICE

CERTIFICATE OF CORRECTION

PATENT NO. : 4,950,868

DATED : August 21, 1990

INVENTOR(S) : Gary Moss, et al.

It is certified that error appears in the above-identified patent and that said Letters Patent is hereby corrected as shown below:

Claim 18, column 6, line 65, cancel "suer" and substitute -user-

Signed and Sealed this

Twenty-fourth Day of December, 1991

*Attest:*

HARRY F. MANBECK, JR.

*Attesting Officer*

*Commissioner of Patents and Trademarks*